US007282858B2

(12) United States Patent
Tokai et al.

(10) Patent No.: US 7,282,858 B2
(45) Date of Patent: Oct. 16, 2007

(54) GAS-DISCHARGE TUBE AND DISPLAY APPARATUS

(75) Inventors: Akira Tokai, Kawasaki (JP); Hitoshi Yamada, Kawasaki (JP); Manabu Ishimoto, Kawasaki (JP); Kenji Awamoto, Kawasaki (JP); Yosuke Yamazaki, Kawasaki (JP); Hitoshi Hirakawa, Kawasaki (JP); Akira Nakazawa, Kawasaki (JP); Koji Shinohe, Kawasaki (JP)

(73) Assignee: Shinoda Plasma Corporation, Hyogo (JP)

( * ) Notice: Subject to any disclaimer, the term of this patent is extended or adjusted under 35 U.S.C. 154(b) by 132 days.

(21) Appl. No.: 10/786,056

(22) Filed: Feb. 26, 2004

(65) Prior Publication Data

US 2005/0088091 A1 Apr. 28, 2005

(30) Foreign Application Priority Data

Oct. 23, 2003 (JP) ..... 2003-363717

(51) Int. Cl.
*H01J 1/62* (2006.01)

(52) U.S. Cl. ..... 313/582; 313/607

(58) Field of Classification Search ..... 313/582–584, 313/607

See application file for complete search history.

(56) References Cited

U.S. PATENT DOCUMENTS 4,752,935 A * 6/1988 Beck ..... 372/55
4,956,577 A * 9/1990 Parker ..... 313/634
6,633,117 B2 * 10/2003 Shinoda et al. ..... 313/484
6,650,055 B2 * 11/2003 Ishimoto et al. ..... 313/623

FOREIGN PATENT DOCUMENTS

| | | | |
|---|---|---|---|
| CN | 1404090 A | | 3/2003 |
| CN | 1448978 A | | 10/2003 |
| JP | 61-103187 | | 5/1986 |
| JP | 64-7669 | | 1/1989 |
| JP | 01007669 A | * | 1/1989 |

OTHER PUBLICATIONS

Chinese Office Action issued on Jul. 7, 2006 for Chinese Patent application No. 200410007270.1 (5 pgs); translation (7 pgs).

* cited by examiner

*Primary Examiner*—Nimeshkumar D. Patel
*Assistant Examiner*—Anthony Perry
(74) *Attorney, Agent, or Firm*—Staas & Halsey LLP

(57) ABSTRACT

A gas-discharge tube has a glass tube as its main body and a trench is provided in the axial direction of the glass tube on one surface (the surface opposed to the discharge surface) among the external surfaces of the glass tube. An address electrode is placed in the trench. The inner surface of the region of the glass tube where sustain electrodes are placed is formed to have a microscopic unevenness. A secondary electron emission film is formed on this inner surface where the unevenness is formed. In addition, a phosphor support member, whose cross section across the axis is in approximately a C-shape and where a phosphor layer has been formed in advance on the inner surface, is placed inside of the glass tube. Stable discharge characteristics is obtained by eliminating dispersion of the position of an electrode, relative to the gas-discharge tube.

10 Claims, 10 Drawing Sheets

GAS-DISCHARGE TUBE AND DISPLAY APPARATUS

BACKGROUND OF THE INVENTION

1. Field of the Invention

The present invention relates to a gas-discharge tube in which a discharge gas is sealed as a discharge medium and to a display apparatus that can display images, (video image), including a dynamic image, by aligning a large number of such gas-discharge tubes in parallel form.

2. Description of Related Art

Large scale display apparatuses have been proposed wherein a gas-discharge tube is constructed such that a phosphor is provided inside of a long and narrow transparent insulating tube and a discharge gas is sealed in the tube in the same manner as PDP (Plasma Display Panel) using the same illumination principle and wherein a large number of such gas-discharge tubes are aligned in parallel form and thereby video images, including a dynamic image, can be displayed (see, for example, Japanese Patent Application Laid-Open No. 61-103187 (1986)). Such a display apparatus is a self-emission type display apparatus that can display a video image of high luminance and can realize a large display exceeding a one hundred inch display, and therefore, is preferable in the case when an entire indoor wall is used as a display apparatus.

FIG. 1 is a schematic perspective view showing one example of a conventional display apparatus utilizing gas-discharge tubes and FIG. 2 is a schematic cross-sectional view showing the structure of the display apparatus along line X-X of FIG. 1. In the following, the conventional display apparatus and the gas-discharge tubes utilized therein are described in reference to FIG. 1 and FIG. 2. Here, gas-discharge tubes having a rectangular cross-section are disclosed in the above described Japanese Patent Application Laid-Open No. 61-103187 (1986) while gas-discharge tubes having a circular cross-section are utilized in the conventional example shown in FIG. 1 and FIG. 2.

The conventional display apparatus 80 has a large number of gas-discharge tubes 90, 90, . . . aligned in parallel form in the direction perpendicular to the direction of their axes and has a structure wherein these gas-discharge tubes 90, 90, . . . are sandwiched between a rear support member (substrate) 96 and a front support member (substrate) 98. Address electrodes (also referred to as selection electrodes) 97, 97, . . . are provided in the direction of the axes of gas-discharge tubes 90, respectively, on the surface of the gas-discharge tube 90 side of the rear support member 96. On the other hand, sustain electrodes (also referred to as display electrodes) 99, 99, . . . whose longitudinal direction is in a direction that crosses the direction of the address electrodes 97 in the plan view are provided with predetermined intervals on the surface of the gas-discharge tube 90 side of the front support member 98. Here, each of the sustain electrodes is formed of a pair of electrodes 99*a* and 99*b*.

In each gas-discharge tube 90, a glass tube 91, having light transmission properties in a hallow cylindrical form, which is a long and narrow transparent insulating tube having an internal diameter of, for example, 0.8 mm and a thickness of 0.1 mm is utilized. A secondary electron emission film (also referred to as a protection film) 92 for lowering the level voltage (discharge voltage) required for the occurrence of discharge is formed to have a uniform film thickness on the inner side of glass tube 91. Furthermore, a phosphor support member 94 in approximately C shape in the cross section across the axis is provided on the inner side of the secondary electron emission film 92. Moreover, a phosphor layer 93 that excites a vacuum ultraviolet light (ultraviolet light) generated by discharge to a visible light is formed on the portion of rear support member 96 side of the inner surface of phosphor support member 94. In addition, a discharge gas 95 such as Xe—Ne or Xe—He is sealed inside of glass tube 91.

Each region defined by an address electrode 97 and each pair of sustain electrodes 99*a* and 99*b*, which cross each other, forms a unit emitting region (cell). One of the pair of sustain electrodes 99*a* and 99*b* is used as a scan electrode such that a voltage is applied between this scan electrode and address electrode 97 and thereby an address discharge (opposed discharge) for a on-state writing selectively occurs so that a wall charge occurs on the inner wall of glass tube 91 that corresponds to the cell where this address discharge has occurred. Subsequently, a voltage is applied between the pair of sustain electrodes 99*a* and 99*b* and thereby a on-state discharge (surface discharge) for a on-state sustain occurs in the cell where the wall charge has occurred due to the address discharge. This on-state discharge makes Xe in the discharge gas to collide with an electron so that an ultraviolet light is emitted. The ultraviolet light is excited to a visible light by means of phosphor layer 93 and this visible light is emitted to the outside. In this manner, an electrical field in each cell is controlled in accordance with voltages applied to sustain electrodes 99*a*, 99*b* and address electrode 97 and thereby the occurrence of an ultraviolet light is controlled so that the conventional display apparatus can display a video image of high luminance.

In the conventional display 80 shown in FIG. 1 and FIG. 2, however, the rear support member 96 and the front support member 98 are arranged in a condition where they sandwich glass discharge tubes 90, 90, aligned in parallel form. As a result, in some cases a gap A generates between adjacent gas-discharge tubes 90 and 90. In such a case, a dispersion occurs at distance X between an address electrode 97 provided on the rear support member 96 with a predetermined dimension precision by use of a technique, such as photolithography, and center line B of each gas-discharge tube 90 and, therefore, a problem arises wherein the amount of the opposed discharge and the region of the occurrence of the opposed discharge differ from each cell. In addition, even in the case where discharge tubes 90 are aligned in such a manner as to prevent gap A from occurring, a dispersion of the external diameter can easily occur in glass tubes 91 having circular cross sections in comparison with address electrodes 97, 97, . . . that can be easily maintained at equal intervals and, therefore, there is a fear that the same situation as described above may occur.

In particular, when the gas-discharge tube 90 has a circular external shape as shown in FIG. 1 and FIG. 2, there is even a fear where an address electrode 97 and the external surface of a glass tube 91 do not make a direct contact with each other in the case where the above described distance X becomes large. In such a case, air having an extremely low dielectric constant intervenes between the external surface of the glass tube 91 and the address electrode 97 and, therefore, a voltage that must be applied to address electrode 97 in order to make an opposed discharge occur becomes high. In the case where the voltage that must be applied to address electrode 97 in order to make this opposed discharge occur becomes higher than the voltage that can be applied to address electrode 97, it becomes impossible to make the opposed discharge occur resulting in a problem where a display defect occurs.

In addition, the secondary electron emission film (metal oxide film such as magnesium oxide or alumina) 92 prevents ion impact to glass tube 91 functioning as a dielectric and at the same time plays an important role such as emitting secondary electrons for the discharge. As for a method for forming such secondary electron emission film 92, a method (coating thermal decomposition method) has been widely and conventionally used where a solution (liquid to be coated) containing organic fatty acid salt (for example, fatty acid magnesium) is introduced inside of the glass tube 91 so as to be coated to the inner surface thereof, and the liquid that has been coated is baked so that the secondary electron emission film 92 is formed on the inner surface of glass tube 91.

It is preferable for gas-discharge tube 90 utilized in the display apparatus 80 to have a short opposing distance between address electrode 97 and sustain electrode 99*a* (99*b*) in glass tube 91 in order to lower the voltage required for the occurrence of the opposed discharge for the purpose of cost reduction, lowering of the consumed power and the like. In the case where the cross section across the axis of glass tube 91 has a circular inner peripheral shape (hereinafter referred to as a cylindrical tube) as shown in FIG. 1 and FIG. 2, the surface tension applied to the coated liquid becomes uniform and therefore, secondary electron emission film 92 having approximately uniform film thickness distribution can be formed. However, in the case where the above described gas-discharge tubes having a rectangular cross section as disclosed in Japanese Patent Application Laid-Open No. 61-103187 (1986) are utilized, the surface tension applied to the coated liquid becomes non-uniformed due to the inner peripheral shape of the cross section across the axis of the glass tubes being rectangular (including the case of being approximately elliptical) and therefore the coated liquid tends to collect to regions (bent portions) having a smaller curvature radius due to capillarity. Accordingly, in the case where glass tubes which are not cylindrical tubes as disclosed in Japanese Patent Application Laid-Open No. 61-103187 (1986) are used, the film thickness of the secondary electron emission film 92 in the bent portions of the cross section of the glass tubes becomes large while the film thickness of the secondary electron emission film 92 in the regions having a great curvature radius becomes small.

As described above, it is preferable for gas-discharge tubes utilized in the display apparatus 80 to have a glass tube 91 where the opposing distance between the address electrode 97 and the sustain electrode 99*a* (99*b*) is short. As a result, in the case where glass tubes which are not cylindrical tubes are utilized, the address electrode and the sustain electrode are formed such that the curvature radius in the glass surface (side surface) that defines the opposing distance between the two is smaller than the curvature radius in the glass surface (discharge surface) on the sustain electrode 99*a* (99*b*) side, which is a surface discharge region. As a result of this, a problem arises wherein the secondary electron emission collects to the side surface in the configuration while the secondary electron emission efficiency deteriorates leading to a rise of the sustain voltage in the glass surface on the sustain electrode side due to the reduction in the film thickness of the secondary electron emission film 92.

On the other hand, the phosphor support member 94 is generally manufactured by a redraw method wherein a glass tube is processed in advance to have a shape such that the cross section thereof has a shape approximately similar to the desired shape and then the processed glass tube is heat stretched. However, in the case of the phosphor support member 94 where the cross section thereof is not point symmetrical, the tension at the time of the heat stretching does not become uniformed causing deformation easily. Accordingly, distance Y between the inner surface (discharge surface) on the sustain electrode 99*a* (99*b*) side, which is a region where a surface discharge occurs, and the phosphor support member 94, that is to say, the phosphor layer 93 becomes large, which causes a problem wherein the excitation efficiency is reduced when the ultraviolet light having been generated by the charge excites the phosphor layer 93 and the brightness is reduced.

BRIEF SUMMARY OF THE INVENTION

The present invention has been achieved in order to solve the above described problems and an object thereof is to provide a gas-discharge tube with stable discharge characteristics by eliminating dispersion of the position of the electrode relative to the gas-discharge tube, and to provide a display apparatus in which a large number of such gas-discharge tubes are arranged.

In addition, another object of the present invention is to provide a gas-discharge tube with stable discharge voltage characteristics by increasing film thickness of a secondary electron emission film in the vicinity of the region where the discharge occurs so that the secondary electron emission efficiency increases, and to provide a display apparatus in which a large number of such gas-discharge tubes are arranged.

Furthermore, still another object of the present invention is to provide a gas-discharge tube with excellent brightening characteristics by forming a uniform film thickness of a secondary electron emission film and at the same time by increasing contact area between an electrode and a tubular body so as to expand the discharge region, and to provide a display apparatus in which a large number of such gas-discharge tubes are arranged.

Moreover, yet another object of the present invention is to provide a gas-discharge tube with excellent brightening characteristics by placing the member on which phosphor is arranged close to the region where the discharge occurs so that ultraviolet light generated by the discharge increases the excitation efficiency when the phosphor is excited, and to provide a display apparatus in which a large number of such gas-discharge tubes are arranged.

A gas-discharge tube according to the first invention is a gas-discharge tube, comprising a tubular body in which a discharge gas is sealed and a plurality of electrodes, for discharging the discharge gas by applying a voltage to each of the plurality of electrodes, wherein a recess portion is formed on an external surface of the tubular body, and at least one electrode among the plurality of electrodes is placed in the recess portion.

In such a gas-discharge tube according to the first invention, the electrode is placed in the recess portion formed on the external surface of the tubular body, and thereby, no positional shift occurs between the electrode placed in the recess portion and the tubular body.

A gas-discharge tube according to the second invention is, in the first invention, characterized in that the recess portion is a trench extending in the axial direction of the tubular body.

In such a gas-discharge tube according to the second invention, the recess portion formed on the external surface of the tubular body is the trench extending in the axial direction of the tubular body, and thereby, rotational movement along the trench can be generated in a conductive paste, which is a fluid, promoting the flow of the conductive paste in the direction of rotation, that is to say in the longitudinal direction of the trench, so that the conductive paste is coated to the inside of the trench in a stable manner in the case where the conductive paste is coated in the trench, in accordance with the dispenser method. In addition, it is possible to form, in a stable manner, the trench extending in the axial direction of the tubular body by a well-known redraw method.

A gas-discharge tube according to the third invention is, in the first or second invention, characterized in that electrodes not being placed in the recess portion among the plurality of electrodes are placed on an external surface of the side opposed to the recess portion of the tubular body, the inner surface of the portion of the tubular body, where the recess portion is formed, is formed to have a protrusion portion toward the inside, and a member on which phosphor is arranged is placed at the inner surface of the portion of the tubular body where the protrusion portion is formed toward the inside.

In such a gas-discharge tube according to the third invention, the inner surface of the tubular body is formed to have a protrusion portion toward the inside in the portion where a recess portion is provided on the external surface of the tubular body, and thereby, the member on which phosphor is arranged is lifted up so that the phosphor becomes closer to the region where an electrode, one among the plurality of electrodes not placed in the above described recess portion, is placed. As a result, the opposing distance between the phosphor and the discharge surface becomes shorter in the case where a surface discharge occurs. Accordingly, a discharge occurs in the vicinity of the phosphor so that the excitation efficiency can be increased when the ultraviolet light generated by the discharge excites the phosphor, and the enhancement of the brightness can be realized. In addition, the distance between the electrodes placed so as to be opposed to each other via the tubular body becomes shorter, and thereby, the voltage required for the occurrence of the opposed discharge can be lowered.

A gas-discharge tube according to the fourth invention is, in any one of the first to third inventions, characterized in that an inner surface of a region of the tubular body, where electrodes not being placed in the recess portion among the plurality of electrodes are placed, is formed to have a microscopic unevenness, and a secondary electron emission film is provided at a portion where the microscopic unevenness is formed.

In such a gas-discharge tube according to the fourth invention, the inner surface of the tubular body of the region where an electrode among the plurality of electrodes not placed in the above described recess portion is placed is formed to have an unevenness and, thereby, the liquid to be coated is held in the recess portion due to capillarity in the case where a secondary electron emission film is formed on the above described inner surface by means of the coating thermal decomposition method so that the secondary electron emission film is formed in the recess portion in a collective manner. That is to say, the region (desired region), where a secondary electron emission film is to be formed, is formed to have a microscopic unevenness and, thereby, it becomes possible to form the secondary electron emission film on this desired region.

A gas-discharge tube according to the fifth invention is a gas-discharge tube, comprising a tubular body in which a discharge gas is sealed and a plurality of electrodes, for discharging the discharge gas by applying a voltage to each of the plurality of electrodes, wherein an inner surface of the tubular body is formed to have a microscopic unevenness, and a secondary electron emission film is provided at a portion where the microscopic unevenness is formed.

In such a gas-discharge tube according the fifth invention, an inner surface of the tubular body is formed to have a microscopic unevenness and, thereby, liquid to be coated is held in a recess portion due to capillarity in the case where a secondary electron emission film is formed on such a portion by means of the coating thermal decomposition method so that the secondary electron emission film is formed in the recess portion in a collective manner. In addition, a region (desired region), where a secondary electron emission film is desired to be formed, is formed to have a microscopic unevenness and, thereby, it becomes possible to form the secondary electron emission film on this desired region in a collective manner.

A gas-discharge tube according to the sixth invention is, in the fifth invention, characterized in that the electrodes include a first electrode placed in the axial direction of the tubular body, and a plurality of second electrodes opposed to the first electrode via the tubular body and being placed at predetermined intervals parallel to the direction crossing the axial direction of the tubular body, and the microscopic unevenness is formed at a region where the plurality of second electrodes is placed.

In such a gas-discharge tube according to the sixth invention, the region of the inner surface of the tubular body where the second electrodes are placed is formed to have a microscopic unevenness. That is to say, the region where the second electrodes are placed is a region where a plane discharge occurs and, therefore, the secondary electron emission film is formed in this region in a selective manner by allowing the region to have a microscopic unevenness in the case where the secondary electron emission film is formed according to the coating thermal decomposition method. Accordingly, the area of the surface of the secondary electron emission film is reduced so that stress inside of the secondary electron emission film is reduced eliminating a fear of the occurrence of cracking even when the film thickness of the required portion has been increased. That is to say, the margin concerning the film thickness is increased and the occurrence ratio of cracking is reduced.

A gas-discharge tube according to the seventh invention is, in the fifth or sixth invention, characterized in that the microscopic unevenness is formed in the axial direction of the tubular body.

In such a gas-discharge tube according to the seventh invention, the microscopic unevenness that has been formed on an inner surface of the tubular body is formed in the axial direction of the tubular body and, thereby, rotational movement in the axial direction can be generated to the liquid to be coated, which is a fluid, so that the flow in the rotational direction is accelerated and the secondary electron emission film is formed in a stable manner. In addition, protrusion portions within the unevenness function as stoppers preventing the liquid to be coated from crossing over. In addition, it is possible to form a shape in the axial direction of the tubular body in a stable manner by means of a well-known redraw method. Here, though the liquid to be coated tends to collect along the left and right edges of a recess portion and a fear arises where the secondary electron emission film becomes thin in the center of the recess portion, a region where the secondary electron emission film becomes thin is eliminated in the case where a plurality of recess portion is formed.

A gas-discharge tube according to the eighth invention is a gas-discharge tube, comprising a tubular body in which a discharge gas is sealed and a plurality of electrodes, for discharging the discharge gas by applying a voltage to each of the plurality of electrodes, wherein an external surface of the region of the tubular body, where at least one electrode among the plurality of electrodes is placed, is formed in a plane shape, the inner periphery of the cross-section across the axis of the tubular body is formed in a circular shape, and a secondary electron emission film is provided at an inner surface of the tubular body.

In such a gas-discharge tube according to the eighth invention, the inner periphery of the cross section across the axis of the tubular body is in a circular shape so that the surface tension applied to the coating liquid becomes uniform in the case where a secondary electron emission film is formed on the inner surface of the tube according to the coating thermal decomposition method and, therefore, a secondary electron emission film having a uniform film thickness distribution is formed. In addition, the external surface of the region of the tubular body, where at least one electrode among the plurality of electrodes is placed, is a plane and, thereby, the area of contact between this electrode and the tubular body increases such that the region where discharge occurs increases and the occurring amount of ultraviolet light increase so as to increase the brightness due to the discharge.

A display apparatus according to the ninth invention is a display apparatus in which a plurality of gas-discharge tubes are arranged parallel to each other, each gas-discharge tube comprising: a tubular body in which a discharge gas is sealed; a first electrode placed in the axial direction of the tubular body; and a plurality of second electrodes opposed to the first electrode via the tubular body and being placed at predetermined intervals parallel to the direction crossing the axial direction of the tubular body, so that the discharge gas is discharged by applying a voltage to each electrode, and the second electrodes of adjacent gas-discharge tubes being electrically connected to each other, wherein a recess portion is formed on an external surface of the tubular body, the first electrode is placed in the recess portion of the tubular body, the inner surface of the portion of the tubular body, where the recess portion is formed, is formed to have a protrusion portion toward the inside, and a member on which phosphor is arranged is placed at the inner surface of the portion where the protrusion is formed toward the inside of the tubular body.

In such a display apparatus according to the ninth invention, gas-discharge tubes where first electrodes have been placed in advance in tubular bodies are placed parallel to each other and, thereby, no disperse of the position of the first electrode relative to the gas-discharge tube occurs in any of the gas-discharge tubes. Accordingly, the size of the opposed discharge or the region of the discharge occurrence does not vary for each gas-discharge tube such that the occurrence of unevenness of color is restricted so as to enhance the quality of the display. In addition, the inside portion of the recess portion formed on the external surface of each tubular body has a protrusion portion toward the inside and, therefore, the member on which phosphor is arranged is lifted up so as to be close to the region where the second electrodes are placed, making the opposing distance between the phosphor and the discharge surface shorter in the case where a plane discharge occurs between the second electrodes. Accordingly, a discharge occurs in the vicinity of the phosphor and, therefore, excitation efficiency is increased to enhance the brightness when the ultraviolet light having been generated by the discharge excites the phosphor. In addition, the opposing distance between the electrodes which are placed so as to face each other via the tubular body becomes shorter and, therefore, the voltage required for the occurrence of the opposed discharge is lowered.

A display apparatus according to the tenth invention is, in the ninth invention, characterized in that the inner surface of a region of each of the tubular body, where the second electrodes are placed, is formed to have a microscopic unevenness, and a secondary electron emission film is provided at a portion of the inner surface where the microscopic unevenness is formed.

In such a display apparatus according to the tenth invention, the region of the inner surface of the tubular body where the second electrodes are placed is formed to have a microscopic unevenness. That is to say, the region where the second electrodes are placed is a region where a plane discharge occurs and, therefore, the secondary electron emission film is formed on this region in a selective manner by allowing the region to have a microscopic unevenness in the case where the secondary electron emission film is formed by the coating thermal decomposition method. Accordingly, the area of the surface of the secondary electron emission film is reduced so that stress inside of the secondary electron emission film is reduced such that a fear of the occurrence of cracking is reduced even in the case where the film thickness of the required portion is increased. That is to say, the margin concerning the film thickness is increased and the occurrence ratio of cracking is reduced.

The above and further objects and features of the invention will more fully be apparent from the following detailed description with accompanying drawings.

DETAILED DESCRIPTION OF THE PREFERRED EMBODIMENTS

In the following, the present invention is described in detail in reference to the drawings showing the embodiments thereof.

Embodiment 1

Figure 1:
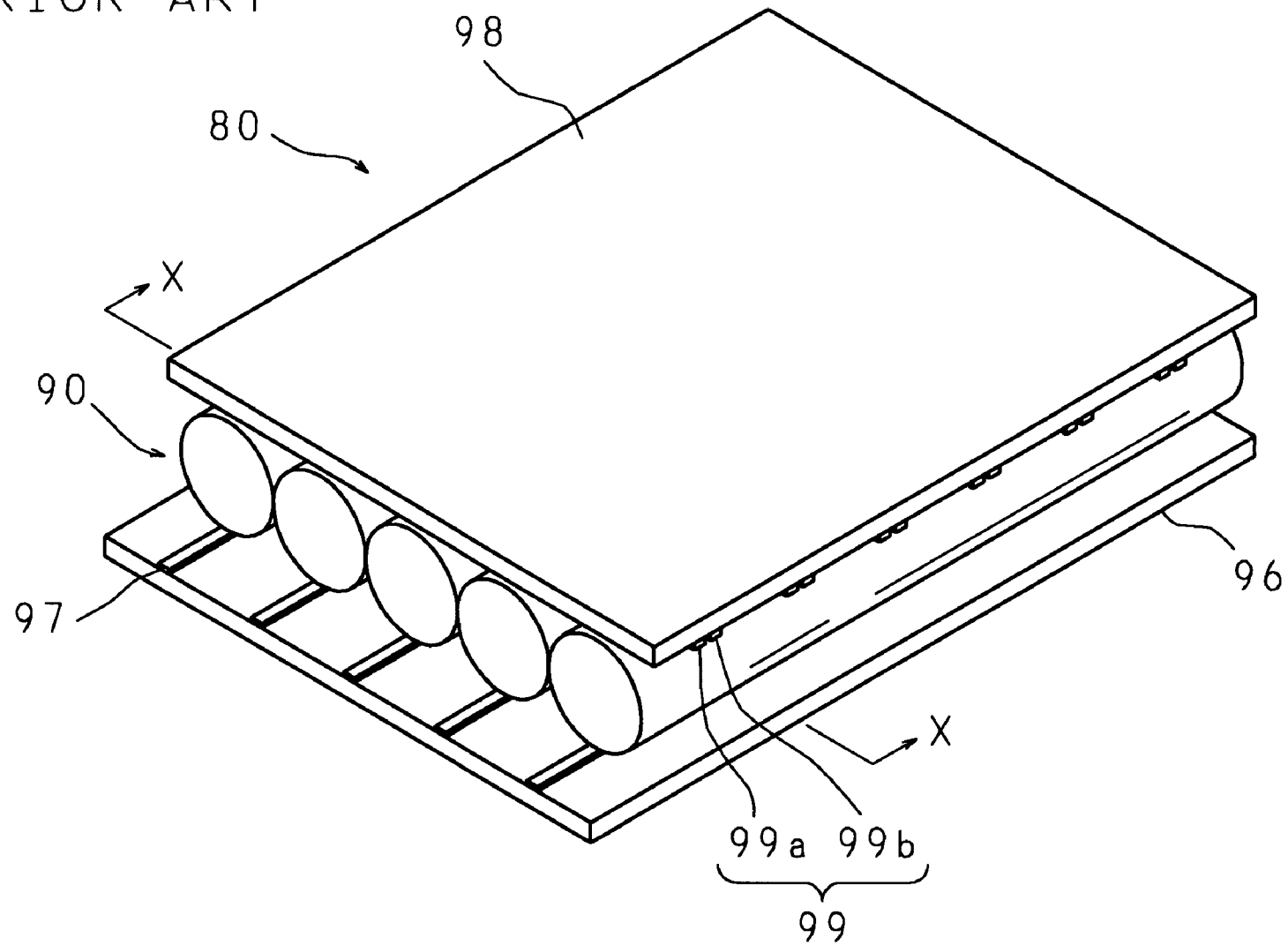
FIG. 1 PRIOR ART
FIG. 1 is a schematic perspective view showing an outlook of one example of a conventional display apparatus using gas-discharge tubes.
Figure 2:
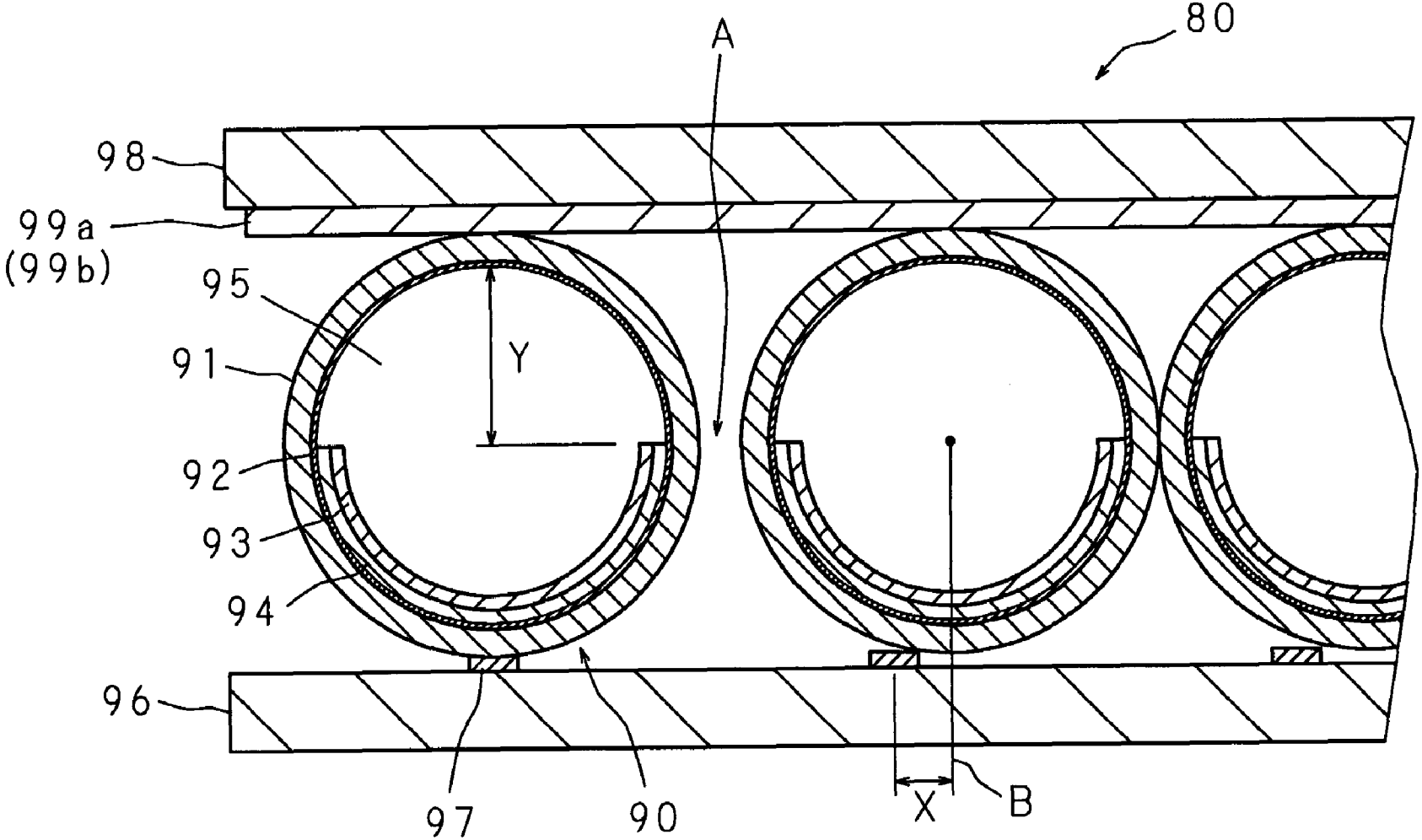
FIG. 2 PRIOR ART
FIG. 2 is a schematic cross sectional view showing a structure along line X-X of FIG. 1.
Figure 3:
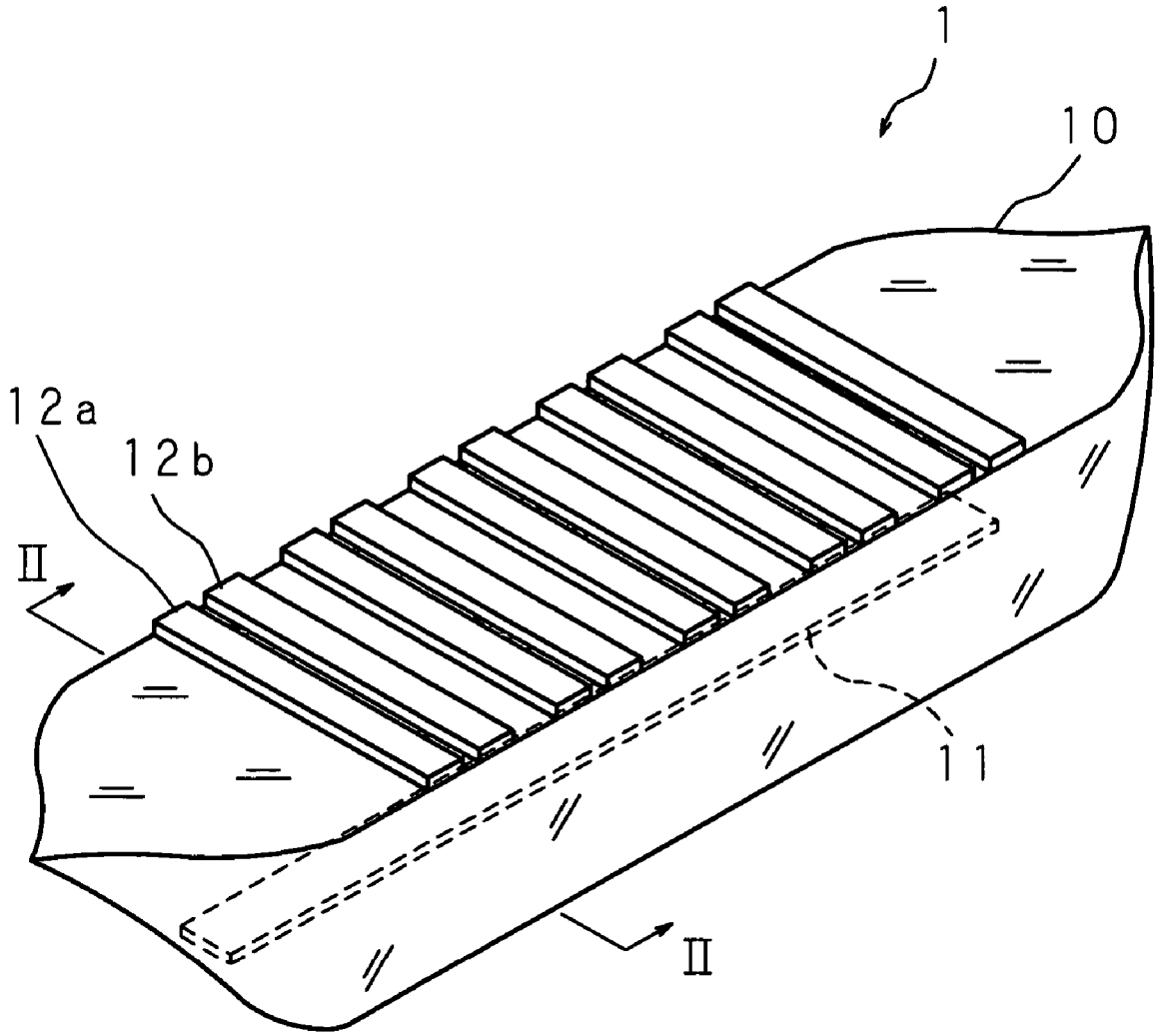
FIG. 3 is a schematic perspective view showing an outlook of a gas-discharge tube according to Embodiment 1 of the present invention.
Figure 4:
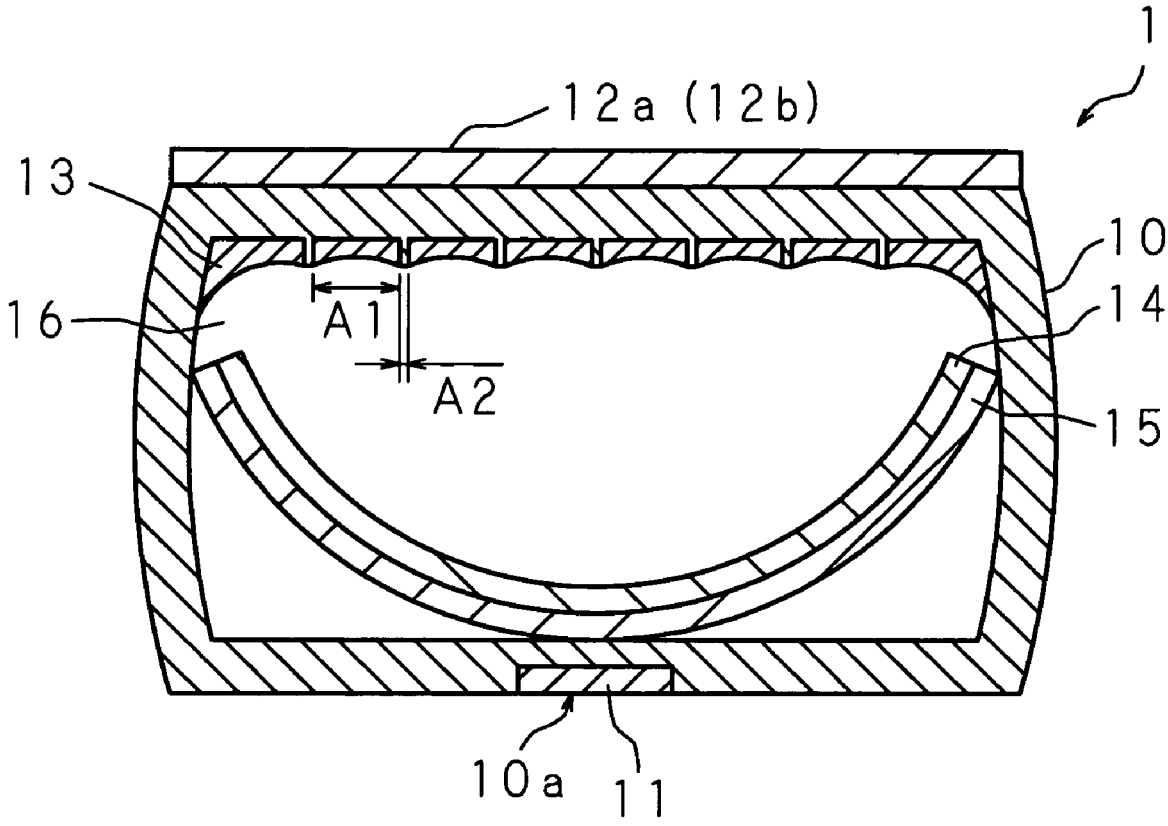
FIG. 4 is a schematic cross sectional view showing a structure along line II-II of FIG. 3.

FIG. 3 is a schematic perspective view showing the outlook of a gas-discharge tube according to Embodiment 1 of the present invention and FIG. 4 is a schematic cross sectional view showing the structure along line II-II of FIG. 3. A gas-discharge tube 1 according to the present Embodiment 1 uses a glass tube 10 made from light transmissible glass (for example, borosilicate glass) as a tubular body whose inner periphery and outer periphery of the cross section across the axis are both approximately rectangular. A trench 10*a* is provided in an axial direction of the glass tube 10 on the outside of one side (the side-facing the discharge surface) within glass tube 10, and an address electrode 11 is placed in this trench 10*a*. On the other hand, a plurality of sustain electrodes 12*a* and 12*b* is placed at predetermined intervals parallel to the direction crossing the axial direction of the glass tube 10 on the external surface of the side that faces the side of glass tube 10 where the address electrode 11 is placed. Accordingly, address electrode 11 and respective sustain electrodes 12*a* and 12*b* are placed in the directions that cross each other in the plan view so that each region defined by the intersection between address electrode 11 and respective sustain electrodes 12*a* and 12*b* becomes a unit emitting region (cell). Here, as described below, it is not necessary to place sustain electrodes 12*a* and 12*b* on the glass tube 10 in the case where a display apparatus is formed by aligning a large number of gas-discharge tubes.

The inner surface of the region of the glass tube 10 where the sustain electrodes 12*a* and 12*b* are placed is formed to have microscopic unevenness in the direction of the length of the sustain electrodes 12*a* and 12*b*, and each protrusion portion and recess portion of the unevenness extends along the axial direction of the glass tube 10. A secondary electron emission film 13 made of a metal oxide such as magnesium oxide or alumina is formed inside of each recess portion of the unevenness in order to lower the voltage (discharge voltage) required for the occurrence of discharge. In addition, a phosphor support member 15, whose cross section across the axis of the glass tube 10 is approximately in a C-shape, is placed inside of glass tube 10. A phosphor layer 14 for converting the ultraviolet light generated by the discharge into visible light is formed on the inner surface of the phosphor support member 15. Accordingly, the phosphor support member 15 and the phosphor layer 14 form a member on which phosphor is arranged. Thus, a discharge gas 16 such as Xe—Ne or Xe—He is sealed inside of the glass tube 10. Here, phosphor layer 14, which is formed in advance by being coated on the phosphor support member 15 and then being baked, is placed within the glass tube 10 by inserting the phosphor support member 15 into the glass tube 10.

The gas-discharge tube 1 having the above described configuration uses one electrode of a pair of the sustain electrodes 12*a* and 12*b* as a scan electrode, and makes address discharge (opposed discharge) for the on-state writing selectively occur by applying a voltage between the scan electrode and the address electrode 11, and subsequently applies a voltage between the pair of sustain electrodes 12*a* and 12*b* so that the on-state discharge (surface discharge) for on-state sustain is made to occur in the cell where the above described address discharge has occurred. Thus, Xe included in discharge gas 16 and an electron collide with each other so as to emit ultraviolet light, which is converted into a visible light by phosphor layer 14.

In the glass tube 10 having the above described configuration, in the case where the secondary electron emission film 13 is formed on the inner surface of the glass tube 10 by means of the coating thermal decomposition method, a solution (liquid to be coated) containing organic fatty acid salt is held in the recess portion due to capillarity because the inner surface thereof is microscopic unevenness, and therefore, the secondary electron emission film 13 can be formed so as to be solely collected in the recess portion. That is to say, the region (desired region) where it is desired to form the secondary electron emission film 13 is made to have microscopic unevenness, and thereby, the secondary electron emission film 13 can be formed in a collective manner in this desired region. According to the present embodiment, the region where the sustain electrodes 12*a* and 12*b* are placed, that is to say, the region where the surface discharge occurs (surface discharge region) is formed to have microscopic unevenness, and thereby, thick secondary electron emission film is formed in the surface discharge region so that secondary electron emission efficiency is increased and stable discharge characteristics are gained.

In addition, a conductive paste (for example, silver paste) is coated to the trench 10*a* using the dispenser method so that address electrode 11 is formed in trench 10*a* by baking or heat curing, and therefore, the address electrode 11 can be formed in the desired region in the case where the trench 10*a* is formed in advance. Accordingly, there is no fear of a positional shift of the address electrode 11 relative to the glass tube 10 occurring, and therefore, the size of the opposed discharge and the region where the discharge occurs between the address electrode 11 and the sustain electrode 12*a* (or 12*b*) are stabilized. Furthermore, the address electrode 11 is placed in the trench 10*a* so that the opposing distance between the address electrode 11 and the sustain electrodes 12*a*, 12*b* is shortened by the distance corresponding to the depth of the trench 10*a*, and therefore, the voltage required for the occurrence of the opposed discharge can be lowered. As a result, circuit costs and consumed power can be reduced. The address electrode 11 can of course be made by inlaying a conductor into the trench 10*a*.

Figure 5A:
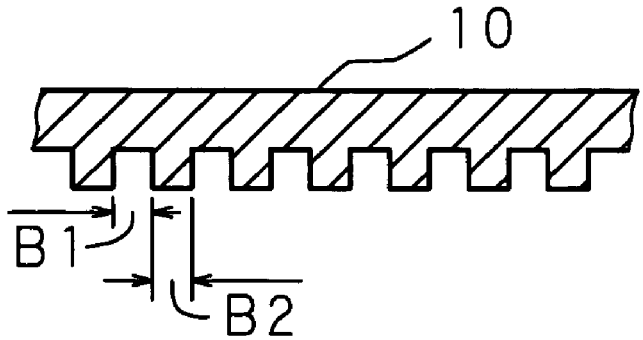
FIG. 5A to FIG. 5D are schematic cross sectional views showing structures of other examples of unevenness provided on an inner surface of a glass tube.
Figure 5B:
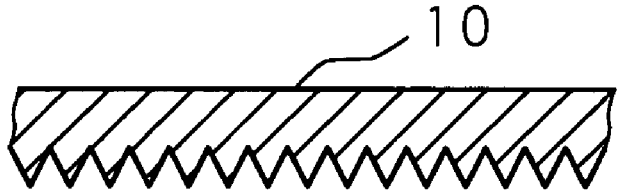
Figure 5C:
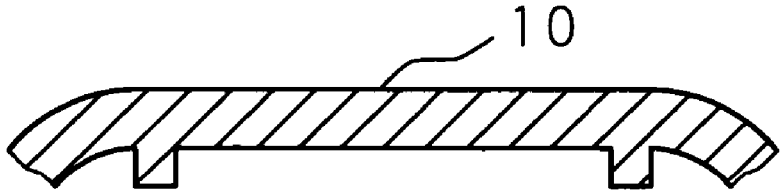
Figure 5D:
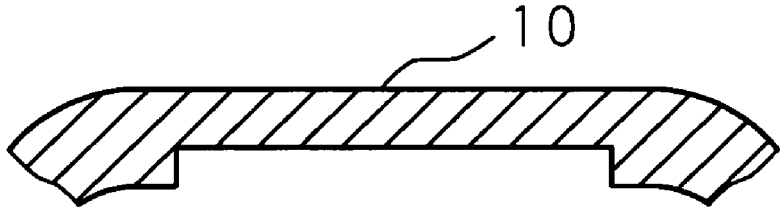

Here, the microscopic unevenness formed on the inner surface of the glass tube 10 is rectangular shaped in the present Embodiment 1 which shows a case where width A1 of the recess portion is greater than width A2 of the protrusion portion (A1>A2), while width B1 of the recess portion and width B2 of the protrusion portion may be the same (B1=B2) as shown in the cross sectional view of FIG. 5A. In addition, the unevenness may be serrate shaped having tapers as shown in FIG. 5B instead of being rectangular shaped as shown in the cross sectional view of FIG. 5A. As described above, the pattern of the unevenness is not limited to a certain form. In other words, the region where the secondary electron emission film 13 is formed and the film thickness can be controlled by selecting the pattern of the unevenness, and therefore, the unevenness can be designed so as to realize the desired secondary electron emission efficiency. In the case where the unevenness is serrate shaped with tapers, mold release and molding become easy during inner surface processing, utilizing dies and the like. The numbers of the recess portion and the protrusion portion are of course not limited. In addition, a pattern may be used where stoppers for preventing the liquid to be coated from crossing over the protrusion portion are provided on both sides of the inner surface of the glass tube 10 as shown in FIG. 5C, or a pattern may be used where portions functioning as stoppers are provided in the form where the center is indented as shown in FIG. 5D.

Figure 6:
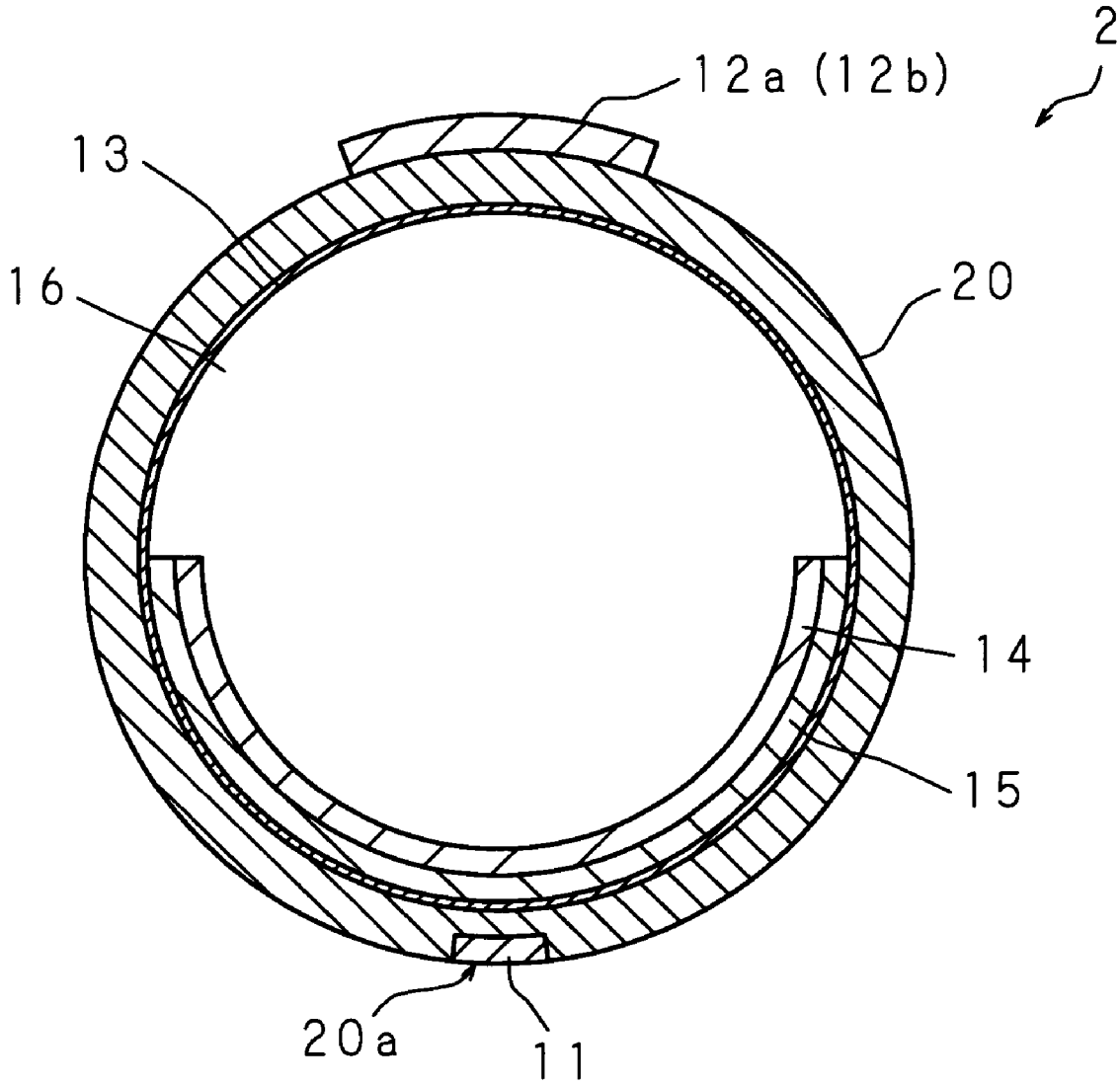
FIG. 6 is a schematic cross sectional view showing a structure of another example of the gas-discharge tube according to Embodiment 1 of the present invention.

In addition, though the external shape of the gas-discharge tube 1 is approximately rectangular is shown in the present Embodiment 1, a gas-discharge tube whose external shape is circular may be used. FIG. 6 is a schematic cross sectional view showing the structure of another example of a gas-discharge tube 2 according to Embodiment 1. The gas-discharge tube 2 whose main body is a glass tube 20 having a circular inner periphery and a circular outer periphery of the cross section across the axis, and being provided with a trench 20*a* in the axial direction on the outside thereof. An address electrode 11 is placed in the trench 20*a*. Sustain electrodes 12*a* and 12*b* are placed at a predetermined interval parallel to the direction that crosses the axial direction thereof on the external surface of the glass tube 20 that faces the address electrode 11. The address electrode 11 and the sustain electrodes 12*a*, 12*b* are placed so as to cross each other in the plan view. Each region defined by the intersection between the address electrode 11 and the sustain electrodes 12*a*, 12*b* becomes a unit emitting region (cell). The configurations of the other parts are the same as in FIG. 4, and therefore, the same reference numeral is given to the corresponding parts, and detailed descriptions thereof are omitted.

In the case where the inner periphery of the cross section across the axis is circular shape as described above, surface tension applied to the coating liquid for forming the secondary electron emission film 13 becomes uniform and therefore, the secondary electron emission film 13, having approximately uniform film thickness distribution, can be formed. Accordingly, it is not necessary to form the inner surface of glass tube 20 with unevenness. Here, as a result of comparison between the above described glass tube 10 whose external shape is approximately rectangular and the glass tube 20 whose external shape is circular, the former has a larger contact area between the sustain electrodes 12*a*, 12*b* and the glass tube 10. Accordingly, the region where the surface discharge occurs is increased in the glass tube 10 whose external shape is approximately rectangular, so that the occurring amount of ultraviolet light is increased and the brightness due to the discharge can be enhanced.

Figure 7:
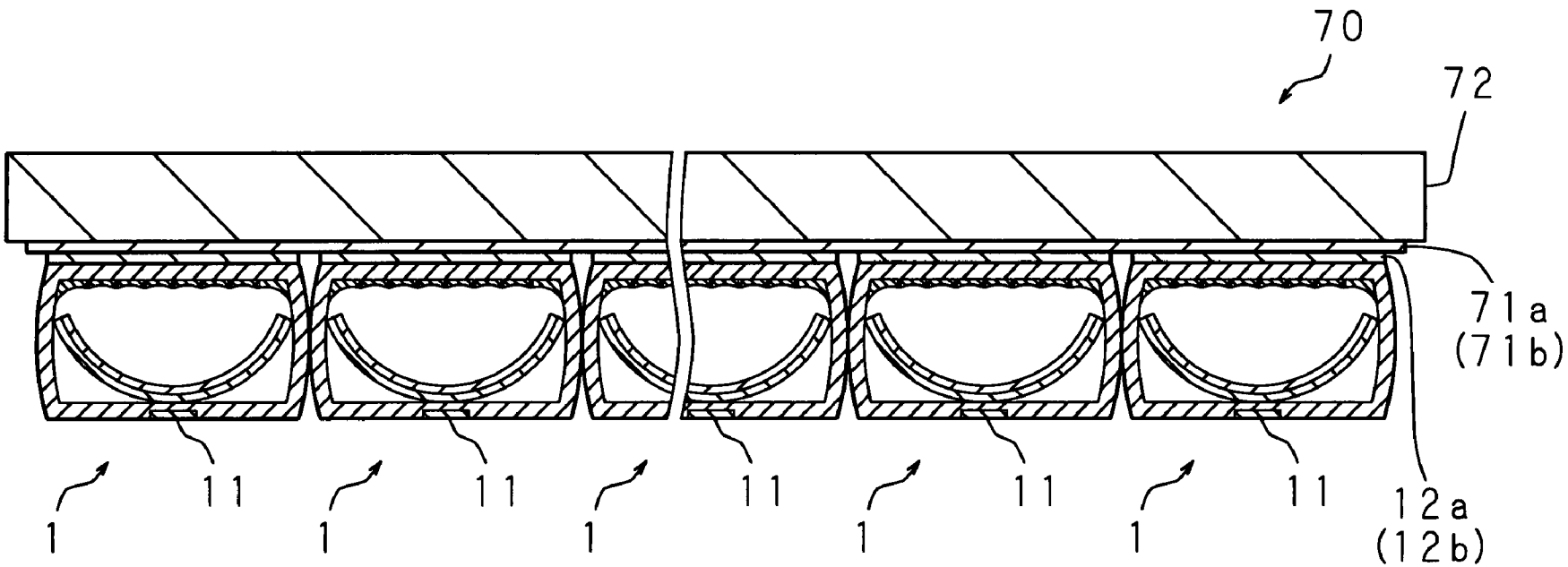
FIG. 7 is a schematic cross sectional view showing a structure of a display apparatus formed by arranging a large number of gas-discharge tubes according to Embodiment 1 of the present invention, parallel to each other.

A large scale display apparatus can be realized by arranging such gas-discharge tubes 1 (or 2) parallel to each other or in a matrix. Here, in the case where glass tubes 10 (or 20), where phosphor support members with phosphor layers of three colors, red, green, and blue, formed thereon are provided inside, are periodically arranged, a color display can be realized. FIG. 7 is a schematic cross sectional view showing the structure of a display apparatus formed by arranging a large number of the gas-discharge tubes 1 according to Embodiment 1, parallel to each other. The display apparatus 70, according to the present invention, has a configuration wherein the sustain electrodes 12*a* and 12*b* made of transparent conductive films such as ITO are connected to bus electrodes 71*a* and 71*b* above a front support member 72 on which the bus electrodes 71*a* and 71*b* made of a metal such as Ag are formed at predetermined intervals, and in addition, the above described gas-discharge tubes 1, 1, are arranged parallel to each other in the direction perpendicular to the axial direction thereof. A glass plate, resin film and the like, having an excellent light transmission rate in the visible light region can be utilized as the front support member 72. The bus electrodes 71*a* and 71*b* are provided with functions for lowering the line resistance and for supplying a voltage to the sustain electrodes 12*a* and 12*b* from an external circuit that is provided outside the system. On the other hand, an address electrode 11 is attached to the external surface of the gas-discharge tube 1 as described above, and a voltage is directly supplied to this address electrode 11 form the external circuit, which is not shown. Here, in such a display apparatus of the present invention, the bus electrodes 71*a* and 71*b* may also be used as the sustain electrodes 12*a* and 12*b*. In this case, it is not necessary to provide the sustain electrodes 12*a* and 12*b* to the gas-discharge tubes 1.

In such a display apparatus 70 of the present invention, a positional relationship between the address electrode 11 for determining (size and the region of) the opposed discharge, and the sustain electrode 12*a* (or 12*b*) becomes the same for all the gas-discharge tubes 1. As a result, even in the case where a gap is formed between adjacent gas-discharge tubes 1, there is no fear of the size and the region of the opposed discharge for each cell being different from each other, so that stable discharge characteristics can be obtained. In particular, a condition where the address electrode 11 does not make direct contact with the external surface of the glass tube 20 will never occur in the display apparatus where a large number of the gas-discharge tubes 2, which are cylindrical tubes as shown in FIG. 6, are arranged parallel to each other.

Figure 8:
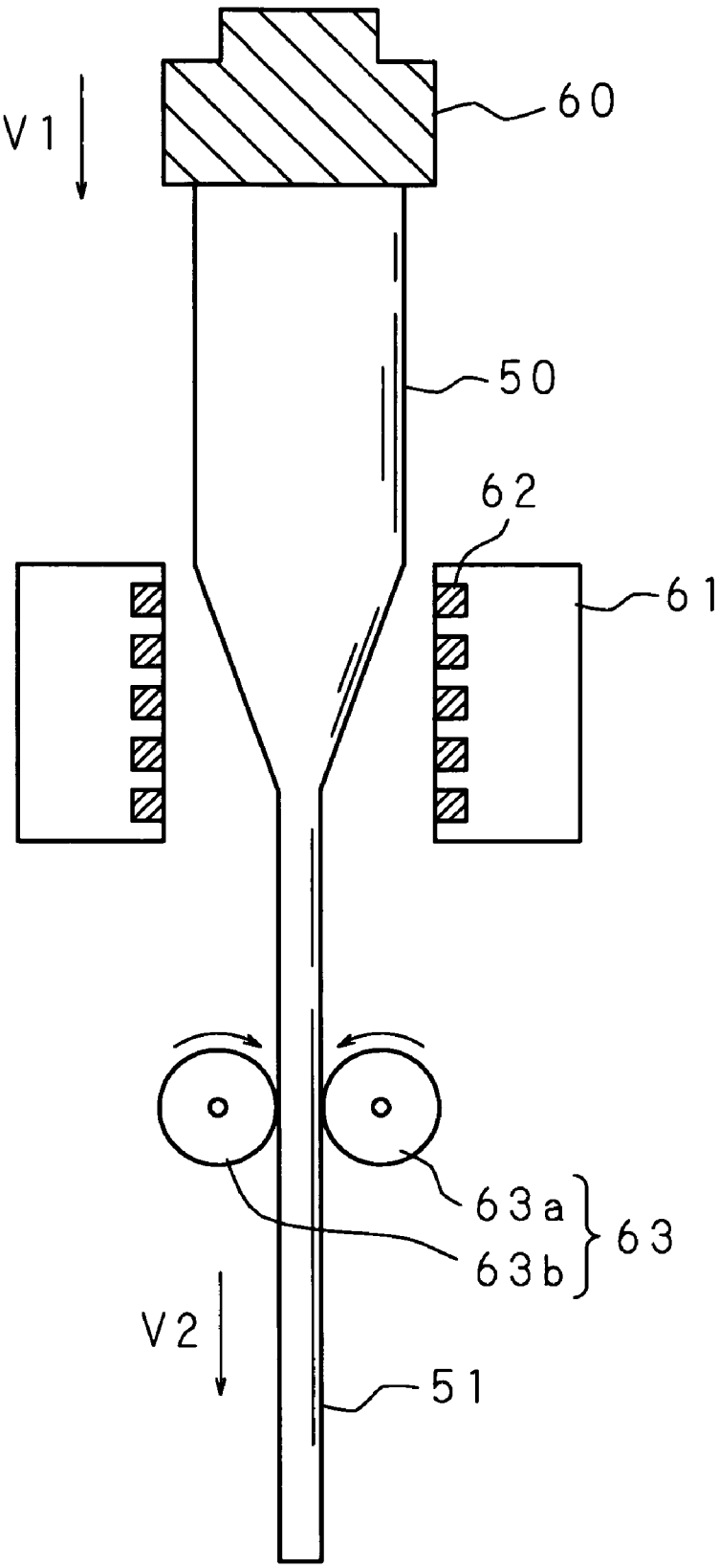
FIG. 8 is a diagram showing a manufacturing method for a glass tube used in the gas-discharge tube according to Embodiment 1 of the present invention.

Next, the redraw method is described as an example of a method for manufacturing the glass tube 10, having the above described shape, wherein a glass tube is processed in advance to have a shape of the cross section similar to the desired shape and the glass tube having been processed into such a shape is formed to have the desired shape by heating it. FIG. 8 is a diagram for illustrating the method for manufacturing a glass tube used for the gas-discharge tube according to Embodiment 1. The glass tube (hereinafter referred to as the main material) before redrawing is denoted as 50 in the figure. The main material 50 has, in advance, a cross section similar to the final shape. One end portion of the main material 50 is secured to a main material folder 60. The main material folder 60 is set to move at a feeding speed V1 along a feeding path in one direction (downward in FIG. 8). That is to say, the main material 50 is fed out at the feeding speed V1 by the main material folder 60. Here, the main material 50 has a large cross section across the axis allowing for easy process and has a shape similar to that of the glass tube 10, that is to say, an approximately rectangular shape where a trench is provided on one surface among the external surfaces thereof in the axial direction, and where the inner surface thereof is processed to have an unevenness. It is easy to process the main material 50 into a shape with a desired cross section by using, for example, a die, a mandrel, and the like, according to a concrete method for processing the main material 50.

The main material 50 is heated to a working temperature of a softening temperature (for example, 820° C. for borosilicate glass) or higher, by means of a heating apparatus 61 placed at midway of the feeding path, and in addition, the main material 50 is drawn by means of a drawing roller 63 provided on the downstream side of the feeding path (path line) so that a glass tube (hereinafter referred to as a tubule) 51, having a cross section smaller then that of the main material 50, is formed. Here, the heating apparatus 61 is provided with a plurality of resistance heaters 62, 62, . . . and a temperature sensor not shown is provided for each resistance heater 62. The temperature sensor detects the temperature at the position of the main material 50 heated by the resistance heater 62. In addition, a control unit, which is not shown, is connected to the heating apparatus 61. The control unit appropriately adjusts the output of each resistance heater 62 based on the temperature detected by the above described temperature sensor so as to maintain the working temperature.

The drawing roller 63 is constructed by a pair of rollers 63*a* and 63*b*. The leading end of the extended tubule 51 is pinched between a pair of rollers 63*a* and 63*b*, and a drawing speed V2 is controlled so that the feeding speed V1 of the main material 50 by means of the main material folder 60 and the drawing speed V2 of the tubule 51 by means of the drawing roller 63 have a constant speed ratio (V1<V2).

The tubule 51, which has been formed according to such a method, is stabilized in shape similar to the shape of the main material 50 when a period of time (approximately several minutes) has passed after the start of the extension. Therefore, in the present embodiment, the tubule 51 corresponds to the glass tube 10 in which a trench is provided in the axial direction thereof on a surface among the external surfaces, and whose inner periphery and outer periphery of the cross section across the axis are both rectangular in form.

Embodiment 2

Figure 9:
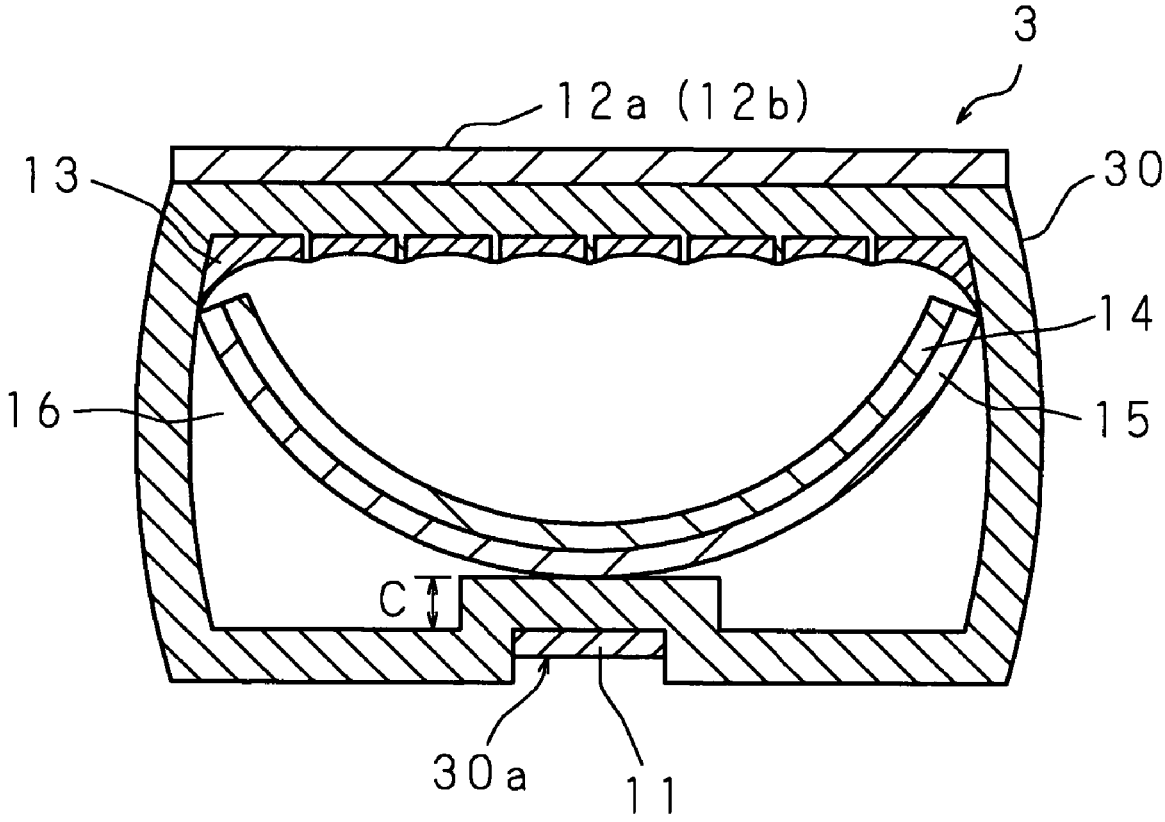
FIG. 9 is a schematic cross sectional view showing a structure of a gas-discharge tube according to Embodiment 2 of the present invention.

FIG. 9 is a schematic cross sectional view showing the structure of a gas-discharge tube according to Embodiment 2 of the present invention. A gas-discharge tube 3 according to Embodiment 2 is made from a glass tube 30 as a main body where the inner periphery and the outer periphery of the cross section across the axis are both rectangular shape. A trench 30*a* is provided in the axial direction of the glass tube 30 on one surface (the surface facing the discharge surface) among the external surfaces of the glass tube 30. The thickness of the glass tube 30 is approximately constant, and the inside of the glass tube 30 of a portion where the trench 30*a* is provided on the external surface has a shape protruding toward the inside. An address electrode 11 is placed in the trench 30*a*. Sustain electrodes 12*a* and 12*b* are placed at a predetermined interval parallel to the direction crossing the axial direction of the glass tube 30 on the external surface of the glass tube 30 of the side opposed to the address electrode 11. The address electrode 11 and the sustain electrodes 12*a*, 12*b* are placed so as to cross each other in the plan view, and each region defined by the intersection between the address electrode 11 and the sustain electrode 12*a*, 12*b* becomes a unit emitting region (cell).

The inner surface of the region of the glass tube 30 where the sustain electrodes 12*a* and 12*b* are placed is formed to have microscopic unevenness in the direction of the length of the sustain electrodes 12*a* and 12*b*, and each protrusion portion and recess portion of the unevenness extends in the axial direction of the glass tube 30. A secondary electron emission film 13 is formed inside of each recess portion of the unevenness. Furthermore, discharge gas 16 is sealed in the glass tube 30. Concretely speaking, the cross section across the axis of the phosphor support member 15 is in approximately a C-shape and the center portion thereof is placed on the inner surface of the above described protruding portion of the glass tube 30 toward the inside. Accordingly, the phosphor layer 14 faces toward the sustain electrodes 12*a* and 12*b*.

In the gas-discharge tube 3 having the above described shape, in addition to that of the above described Embodiment 1, the inner surface of the glass tube 30 is lifted up as the protrusion portion due to the trench 30*a*, and thereby, the phosphor support member 15 is lifted up to the region, that is to say the surface discharge region, where the sustain electrodes 12*a* and 12*b* are placed. As a result, the opposing distance between the phosphor layer 14 formed on the phosphor support member 15 and the discharge surface (sustain electrodes 12*a* and 12*b*) is shortened by height C of the portion protruding toward the inside of the glass tube 30. Accordingly, surface discharge occurs in the vicinity of the phosphor layer 14, and therefore, an excitation efficiency is increased when the ultraviolet light generated by the surface discharge excites the phosphor layer 14 so as to enhance the brightness. Here, the redraw method may be used, allowing the easy manufacture of a glass tube, in the same manner as Embodiment 1 as a method for manufacturing a glass tube having the above described shape, and therefore, the detailed description thereof is omitted.

Embodiment 3

Figure 10:
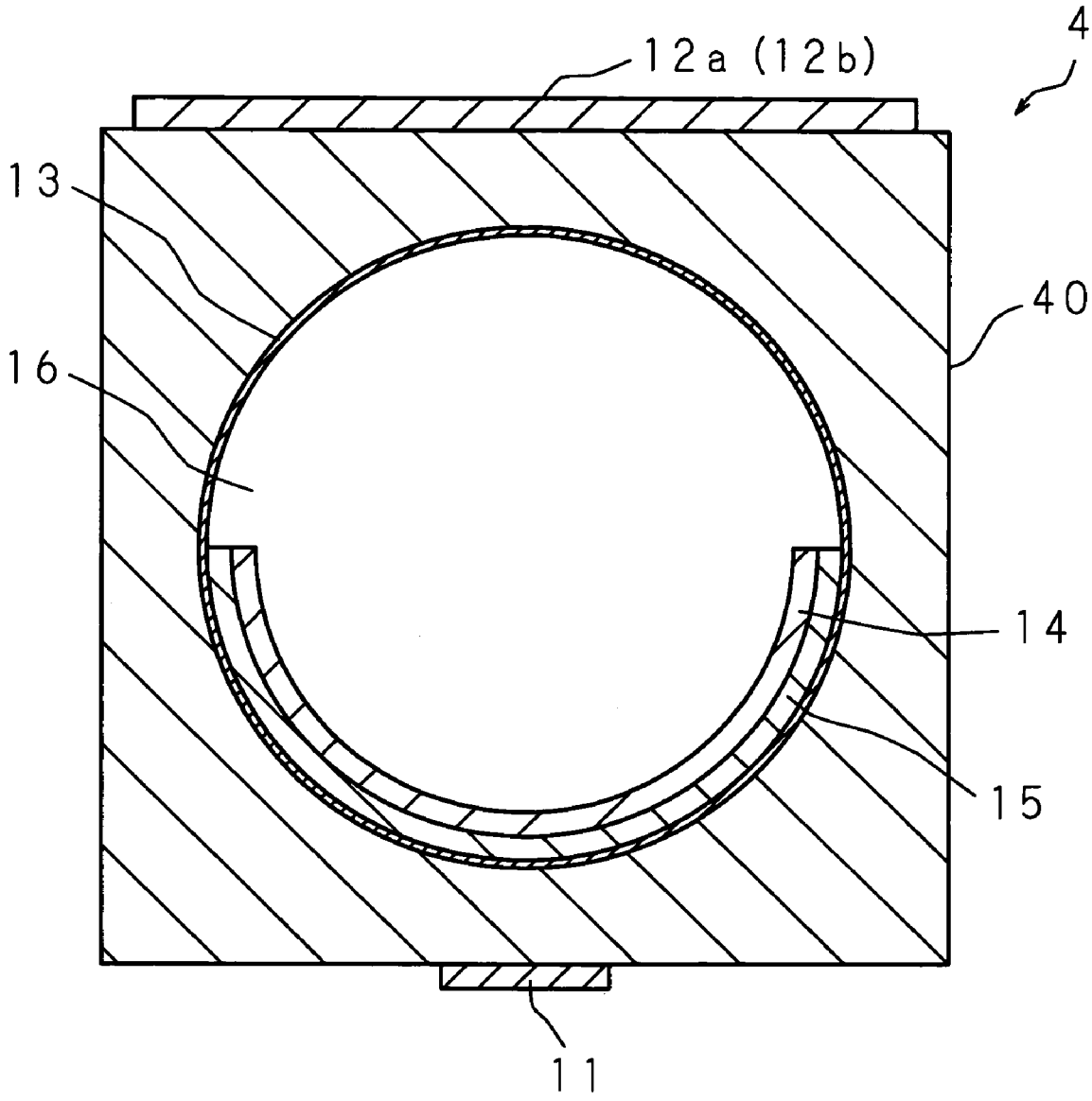
FIG. 10 is a schematic cross sectional view showing a structure of a gas-discharge tube according to Embodiment 3 of the present invention.

FIG. 10 is a schematic cross sectional view showing the structure of a gas-discharge tube according to Embodiment 3. The gas-discharge tube 4 according to Embodiment 3 is made from a glass tube 40 as a main material whose inner periphery of the cross section across the axis is circular shape, and the outer periphery of the cross section across the axis is approximately rectangular shape. An address electrode 11 is placed in the axial direction of the glass tube 40 on an external surface of the glass tube 40. Sustain electrodes 12*a* and 12*b* are placed at a predetermined distance parallel to the direction crossing the axial direction on the external surface of the glass tube 40, opposed to the address electrode 11. The address electrode 11 and the sustain electrodes 12*a* and 12*b* are placed so as to cross each other in the plan view, and each region defined by the intersection between the address electrode 11 and the sustain electrodes 12*a* and 12*b* becomes a unit emitting region (cell).

A secondary electron emission film 13 having a uniform film thickness is formed on the entire inner surface of the glass tube 40 and a phosphor support member 15 whose cross section across the axial direction of the glass tube 40 is approximately in a C-shape is inserted and placed in a region of the inside of the glass tube 40 on the address electrode 11 side. A phosphor layer 14 is formed on the inner surface of the phosphor support member 15. Furthermore, discharge gas 16 is sealed in the glass tube 40. That is to say, in the case where the secondary electron emission film 13 is formed on the inner surface of the glass tube 40 with use of the coating decomposition method, surface tension applied to the coating liquid becomes uniform because the inner periphery of the cross section across the axis of the glass tube 40 is circular shape. Accordingly, the secondary electron emission film 13, having a uniform film thickness distribution, can be formed on the inner surface of the glass tube 40. In addition, the amount of the liquid to be coated and the formed film thickness is in a unique relationship, and therefore, uniform secondary electron emission film 13, having a desired film thickness, can be formed on the inner surface of the glass tube 40 by controlling the concentration of the liquid to be coated.

In addition, the external periphery of the cross section across the axis of the glass tube 40 is approximately rectangular shape in the gas-discharge tube 4, having the above described shape, and therefore, the sustain electrodes 12*a* and 12*b* can be provided in a plane region of the external surface of the glass tube 40. In this case, the area of contact made by the sustain electrodes 12*a*, 12*b* provided in the plane region and by the glass tube 40 is increased so as to increase the region where the surface discharge occurs in comparison with the case where a cylindrical tube is utilized as the main body of the gas-discharge tube. Accordingly, the occurring amount of the ultraviolet light increases so that the brightness due to the discharge can be enhanced. Here, the trench 10*a* (20*a*, 30*a*) as shown in Embodiments 1 and 2 may of course be provided in the glass tube 40 in Embodiment 3 so that the address electrode 11 is placed in the trench.

Here, though constructions where the address electrode 11 is placed in the trench 10*a* (20*a*, 30*a*) are described in the above embodiments, recess portion for the sustain electrodes 12*a*, 12*b* may be provided on the glass tube 10 (20, 30) so that the sustain electrodes 12*a* and 12*b* are placed in those recess portion. In such a case, it is preferable for the sustain electrodes 12*a* and 12*b* to partially protrude from the recess portion so as to be easily connected to the bus electrodes 71*a* and 71*b* when a large number of gas-discharge tubes are arranged to form a display apparatus.

In addition, though constructions where the cross section across the axis of phosphor support member 15 is approximately in a C-shape are described in the above embodiments, the cross section across the axis may be approximately in a "U channel" shape, for example, and the shape thereof is not limited. Here, it is preferable for the phosphor support member 15 to have a shape that fits along the inner periphery of the cross section across the axis of the glass tube so that the surface area of the phosphor layer 14 formed on the inner surface of the phosphor support member 15 increases, enhancing the illumination efficiency.

Furthermore, though three electrode surface discharge type gas-discharge tubes are described in the above embodiments, it is possible to apply the present invention to a two electrode surface discharge type, or opposed discharge type gas-discharge tube. In addition, in the case where the discharge gas directly emits a visible light, the phosphor layer becomes unnecessary and it is not necessary to provide a phosphor support member to the inside of the glass tube.

According to the present invention, an electrode is placed in a recess portion (trench) provided on an external surface of the tubular body (gas discharge tube), and thereby the dispersion of the position of the electrode relative to the gas-discharge tube is eliminated so that stable discharge characteristics can be realized.

In addition, according to the present invention, the inner surface of the tubular body of a desired region, a region where the discharge occurs, for example, is provided with microscopic unevenness and thereby the secondary electron emission film can be formed in this region in a collective manner such that the secondary electron emission efficiency can be increased and stable discharge characteristics can be realized.

Furthermore, according to the present invention, the cross section across the axis of the tubular body has a circular inner peripheral shape, and thereby, the film thickness of the secondary electron emission film is made to be uniform so that the dispersion of the secondary electron emission efficiency can be suppressed, and at the same time, an external surface of the tubular body in a region where at least one electrode among a plurality of electrodes is placed is made to be a plane, and thereby, the contact area between this electrode and the tubular body can be increased, expanding the discharge region so that excellent brightening characteristics can be realized.

Moreover, according to the present invention, the inner surface of the tubular body has a protrusion portion in the portion where a recess portion (trench) is provided on the external surface of the tubular body, and thereby, the member on which phosphor is arranged is lifted up so as to be close to the portion where the discharge occurs so that the excitation efficiency is increased when the ultraviolet light generated by the discharge excites the phosphor and excellent brightening characteristics can be realized, providing excellent effects to the present invention.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A gas-discharge tube, comprising a tubular body in which a discharge gas is sealed and a plurality of electrodes, for discharging said discharge gas by applying a voltage to each of said plurality of electrodes, wherein a recess portion is formed on an external surface of said tubular body, said plurality of electrodes include a plurality of pairs of sustain electrodes for displaying an image and an address electrode for selectively activating said pairs of sustain electrodes, said plurality of pairs of sustain electrodes are formed on the external surface of said tubular body at a position opposite to said recess portion, and an entireness of said address electrode is placed thoroughly inside of said recess portion.

2. The gas-discharge tube as set forth in claim 1, wherein an inner surface of a region of said tubular body, where electrodes not being placed in said recess portion among said plurality of electrodes are placed, is formed to have a microscopic unevenness, and a secondary electron emission film is provided at a portion where said microscopic unevenness is formed.

3. The gas-discharge tube as set forth in claim 1, wherein electrodes not being placed in said recess portion among said plurality of electrodes are placed on an external surface of the side opposed to said recess portion of said tubular body, the inner surface of the portion of said tubular body, where said recess portion is formed, is formed to have a protrusion portion toward the inside, and a member on which phosphor is arranged is placed at the inner surface of said portion of said tubular body where said protrusion portion is formed toward the inside.

4. The gas-discharge tube as set forth in claim 3, wherein an inner surface of a region of said tubular body, where electrodes not being placed in said recess portion among said plurality of electrodes are placed, is formed to have a microscopic unevenness, and a secondary electron emission film is provided at a portion where said microscopic unevenness is formed.

5. The gas-discharge tube as set forth in claim 1, wherein said recess portion is a trench extending in the axial direction of said tubular body.

6. The gas-discharge tube as set forth in claim 5, wherein an inner surface of a region of said tubular body, where electrodes not being placed in said recess portion among said plurality of electrodes are placed, is formed to have a microscopic unevenness, and a secondary electron emission film is provided at a portion where said microscopic unevenness is formed.

7. The gas-discharge tube as set forth in claim 2, wherein electrodes not being placed in said recess portion among said plurality of electrodes are placed on an external surface of the side opposed to said recess portion of said tubular body, the inner surface of the portion of said tubular body, where said recess portion is formed, is formed to have a protrusion portion toward the inside, and a member on which phosphor is arranged is placed at the inner surface of said portion of said tubular body where said protrusion portion is formed toward the inside.

8. The gas-discharge tube as set forth in claim 7, wherein an inner surface of a region of said tubular body, where electrodes not being placed in said recess portion among said plurality of electrodes are placed, is formed to have a microscopic unevenness, and a secondary electron emission film is provided at a portion where said microscopic unevenness is formed.

9. A display apparatus in which a plurality of gas-discharge tubes are arranged parallel to each other, each gas-discharge tube comprising: a tubular body in which a discharge gas is sealed; a first electrode placed in the axial direction of said tubular body; and a plurality of second electrodes opposed to said first electrode via said tubular body and being placed at predetermined intervals parallel to the direction crossing the axial direction of said tubular body, so that said discharge gas is discharged by applying a voltage to each electrode, and said second electrodes of adjacent gas-discharge tubes being electrically connected to each other, wherein a recess portion is formed on an external surface of said tubular body, said first electrode is placed in said recess portion of said tubular body, the inner surface of the portion of said tubular body, where said recess portion is formed, is formed to have a protrusion portion toward the inside, and a member on which phosphor is arranged is placed at the inner surface of the portion where said protrusion is formed toward the inside of said tubular body.

10. The display apparatus as set forth in claim 9, wherein the inner surface of a region of each of said tubular body, where said second electrodes are placed, is formed to have a microscopic unevenness, and a secondary electron emission film is provided at a portion of said inner surface where said microscopic unevenness is formed.

* * * * *